US005493372A

United States Patent [19]

Mashtare et al.

[11] Patent Number: 5,493,372

[45] Date of Patent: Feb. 20, 1996

[54] METHOD FOR FABRICATING A RESONATOR

[75] Inventors: Dale R. Mashtare, Macedon; William J. Nowak, Webster; Christopher Snelling, Penfield, all of N.Y.

[73] Assignee: Xerox Corporation, Stamford, Conn.

[21] Appl. No.: 319,706

[22] Filed: Oct. 7, 1994

[51] Int. Cl.[6] ..... G03G 15/14

[52] U.S. Cl. ..... 355/271; 310/311; 310/800

[58] Field of Search ..... 355/271, 273, 355/274, 276; 310/311, 325, 800

[56] References Cited

U.S. PATENT DOCUMENTS

| | | | |
|---|---|---|---|
| 3,653,758 | 4/1972 | Trimmer et al. | 355/273 |
| 3,932,035 | 1/1976 | Sato et al. | 355/276 |
| 4,111,546 | 4/1978 | Maret | 355/297 |
| 4,434,384 | 2/1984 | Dunnrowicz et al. | 310/325 |
| 4,543,293 | 9/1985 | Nakamura et al. | 310/800 X |
| 4,713,572 | 12/1987 | Bokowski et al. | 310/323 |
| 4,764,021 | 8/1988 | Eppes | 366/127 |
| 4,784,915 | 11/1988 | Sakagami et al. | 310/800 X |
| 5,016,055 | 5/1991 | Pietrowski et al. | 355/273 |

*Primary Examiner*—William J. Royer
*Attorney, Agent, or Firm*—Lloyd F. Bean, II

[57] ABSTRACT

An imaging device having a non-rigid member with a charge retentive surface moving along an endless path, an imaging system for creating a latent image on the charge retentive surface, a developer for imagewise developing the latent image with toner, a transfer system for electrostatically transferring the developed toner image to a copy sheet, and a resonator for enhancing toner release from the charge retentive surface, producing relatively high frequency vibratory energy and having a portion thereof adapted for contact across the flexible belt member, generally transverse to the direction of movement thereof, the resonator includes a horn member for applying the high frequency vibratory energy to the non-rigid member, having a platform portion, a horn portion, and a contacting portion and extending across the non-rigid member. Vibratory energy producing device is coupled to said horn platform for generating the high frequency vibratory energy required to drive said horn member, the vibratory energy producing device includes a piezoelectric polymer film material. And, a voltage source is provided for driving the vibratory energy producing device.

9 Claims, 5 Drawing Sheets

METHOD FOR FABRICATING A RESONATOR

This invention relates to reproduction apparatus, and more particularly, to an apparatus for uniformly applying high frequency vibratory energy to an imaging surface for electrophotographic applications with optimal energy transfer.

INCORPORATION BY REFERENCE

The following United States patents are specifically incorporated by reference for their background teachings, and specific teachings of the principles of operation, construction and use of resonators for applying toner releasing vibrations to the charge retentive surfaces of electrophotographic devices: U.S. Pat. No. 5,210,577 to Nowak; U.S. Pat. No. 5,030,999 to Lindblad et al.; U.S. Pat. No. 5,005,054, to Stokes et al.; U.S. Pat. No. 4,987,456 to Snelling et al.; U.S. Pat. No. 5,010,369 to Nowak et al.; U.S. Pat. No. 5,025,291 to Nowak et al.; U.S. Pat. No. 5,016,055 to Pietrowski et al.; U.S. Pat. No. 5,081,500 to Snelling; U.S. Pat. No. 5,282,005 "Cross Process Vibrational Mode Suppression in High Frequency Vibratory Energy Producing Devices for Electrophotographic Imaging" by W. Nowak et al.; and U.S. patent application Ser. No. 07/620,520, "Energy Transmitting Horn Bonded to an Ultrasonic Transducer for Improved Uniformity at the Horn Tip", by R. Stokes et al.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder or powder suspension referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly. In a slightly different arrangement, toner may be transferred to an intermediate surface, prior to retransfer to a final substrate.

Transfer of toner from the charge retentive surface to the final substrate is commonly accomplished electrostatically. A developed toner image is held on the charge retentive surface with electrostatic and mechanical forces. A substrate (such as a copy sheet) is brought into intimate contact with the surface, sandwiching the toner thereinbetween. An electrostatic transfer charging device, such as a corotron, applies a charge to the back side of the sheet, to attract the toner image to the sheet.

Unfortunately, the interface between the sheet and the charge retentive surface is not always optimal. Particularly with non-flat sheets, such as sheets that have already passed through a fixing operation such as heat and/or pressure fusing, or perforated sheets, or sheets that are brought into imperfect contact with the charge retentive surface, the contact between the sheet and the charge retentive surface may be non-uniform, characterized by gaps where contact has failed. There is a tendency for toner not to transfer across these gaps. A copy quality defect results.

That acoustic agitation or vibration of a surface can enhance toner release therefrom is known, as described by U.S. Pat. No. 4,111,546 to Maret, U.S. Pat. No. 4,684,242 to Schultz, U.S. Pat. No. 4,007,982 to Stange, U.S. Pat. No. 4,121,947 to Hemphill, Xerox Disclosure Journal "Floating Diaphragm Vacuum Shoe, by Hull et al., Vol. 2, No: 6, November/December 1977, U.S. Pat. No. 3,653,758 to Trimmer et al., U.S. Pat. No. 4,546,722 to Toda et al., U.S. Pat. No. 4,794,878 to Connors et al., U.S. Pat. No. 4,833,503 to Snelling, Japanese Published Patent Application 62-195685, U.S. Pat. No. 3,854,974 to Sato et al., and French patent No. 2,280,115.

Resonators for applying vibrational energy to some other member are known, for example in U.S. Pat. No. 4,363,992 to Holze, Jr., U.S. Pat. No. 3,113,225 to Kleesattel et al., U.S. Pat. No. 3,733,238 to Long et al., and U.S. Pat. No. 3,713,987 to Low.

Coupling of vibrational energy to a surface has been considered in Defensive Publication T893,001 by Fisler. U.S. Pat. No. 3,635,762 to Ott et al., U.S. Pat. No. 3,422,479 to Jeffee, U.S. Pat. No. 4,483,034 to Ensminger and U.S. Pat. No. 3,190,793 Starke.

Resonators coupled to the charge retentive surface of an electrophotographic device at various stations therein, for the purpose of enhancing the electrostatic function, are known, as in: U.S. Pat. No. 5,210,577 to Nowak; U.S. Pat. No. 5,030,999 to Lindblad et al.; U.S. Pat. No. 5,005,054, to Stokes et al.;; U.S. Pat. No. 5,010,369 to Nowak et al.; U.S. Pat. No. 5,025,291 to Nowak et al.; U.S. Pat. No. 5,016,055 to Pietrowski et al.; U.S. Pat. No. 5,081,500 to Snelling; U.S. Pat. No. 5,282,005 to Nowak, et al.; and U.S. Pat. No. 5,329,341 to Nowak, et al.

In the ultrasonic welding horn art, as exemplified by U.S. Pat. No. 4,363,992 to Holze, Jr., where blade-type welding horns are used for applying high frequency energy to surfaces, it is known that the provision of slots through the horn perpendicular to the direction in which the welding horn extends, reduces undesirable mechanical coupling of effects across the contacting horn surface. Accordingly, in such art, the contacting portion of the horn is maintained as a continuous surface, the horn portion is segmented into a plurality of segments, and the horn platform, support and piezoelectric driver elements are maintained as continuous members. For uniformity purposes, it is desirable to segment the horn so that each segment acts individually. However, a unitary construction is also highly desirable, for fabrication and mounting purposes.

It has been noted that even with fully segmented horns, as shown in U.S. Pat. No. 5,010,369 to W. Nowak, et al., there is a fall-off in response of the resonator at the outer edges of the device. A similar fall off is shown in U.S. Pat. No. 4,363,992 to Holze, Jr., at FIG. 2, showing the response of the resonator of FIG. 1.

Of interest is U.S. Pat. No. 4,826,703 to Kisler which suggests that in a coating apparatus controlled by variations in an electrode potential connected to a vibrator. U.S. Pat.

No. 4,546,722 to Toda et al., U.S. Pat. No. 4,794,878 to Connors et al. and U.S. Pat. No. 4,833,503 to Snelling describe ultrasonic transducer-driven toner transfer for a development system, in which a vibration source provides a wave pattern to move or assist in movement of toner from a sump to a photoreceptor. U.S. Pat. No. 4,568,955 to Hosoya et al. teaches recording apparatus with a developing roller carrying developer to a recording electrode, and a signal source for propelling the developer from the developing roller to the recording media.

As exemplified by U.S. Pat. No. 4,363,992 to Holze, Jr., for blade-type welding horns, the horn is coupled with the transducer with a bolt type fastener. U.S. Pat. No. 3,113,225 to Kleesattel et al shows a similar arrangement for other ultrasonic energy applying applications. In the application proposed by the cross-referenced applications, for the release of toner from an image carrying surface, a bolted construction is problematic, as it requires extreme precision in the tightening of the bolts. Any variation of the clamping force will cause asymmetric device behavior, when uniform behavior is sought. The bolt torque can be controlled, but the axial compression cannot be easily controlled. The bolt to thread friction losses are a random bolt to bolt variable.

U.S. Pat. No. 4,713,572 to Bokowski, teaches the use of adhesive in adhering a horn to a piezoelectric element. In U.S. patent application Ser. No. 07/620,520, "Energy Transmitting Horn Bonded to an Ultrasonic Transducer for Improved Uniformity at the Horn Tip", by R. Stokes et al. teaches the use of an epoxy mesh which serves to bond a ceramic piezoelectric elements to the surface of the horn as well as provided electrical contact for the A.C. drive voltage to excite the element. The epoxy mesh behaves as a low pass mechanical filter, attenuating the transfer of energy from the active element to the waveguide. Variations in dimensions of the epoxy mesh, surface finish, and localized pressure during assembly process influence the coupling between the piezoelectric element and the waveguide resulting in nonuniform vibration amplitude across the process width.

A simple, relatively inexpensive and accurate approach to replace costly ceramic piezoelectric elements which are coupled to a horn and to improve the uniformity of vibration has been a goal in the design, and manufacture of such devices. This need has been particularly recognized in the ultrasonic energy applying applications used in electrophotographic printers. The need to provide accurate and inexpensive attachment of a horn to a piezoelectric element has become more acute, as the demand for high quality, electrophotographic printers has increased.

SUMMARY OF THE INVENTION

In accordance with the invention there is provided an imaging device having a non-rigid member with a charge retentive surface moving along an endless path, means for creating a latent image on the charge retentive surface, means for imagewise developing the latent image with toner, means for electrostatically transferring the developed toner image to a copy sheet, and a resonator for enhancing toner release from the charge retentive surface, producing relatively high frequency vibratory energy and having a portion thereof adapted for contact across the flexible belt member, generally transverse to the direction of movement thereof, the resonator comprising a horn member for applying the high frequency vibratory energy to the non-rigid member, having a platform portion, a horn portion, and a contacting portion and extending across the non-rigid member. Vibratory energy producing means are coupled to said horn platform for generating the high frequency vibratory energy required to drive said horn member, the vibratory energy producing means comprises a piezoelectric polymer film material. And, a voltage source is provided for driving the vibratory energy producing means.

These and other aspects of the invention will become apparent from the following description used to illustrate a preferred embodiment of the invention read in conjunction with the accompanying drawings in which.

Printing machines of the type contemplated for use with the present invention are well known and need not be described herein. U.S. Pat. No. 5,210,577 to Nowak; U.S. Pat. No. 5,030,999 to Lindblad et al.; U.S. Pat. No. 5,005,054 to Stokes et al.; U.S. Pat. No. 4,987,456 to Snelling et al.; U.S. Pat. No. 5,010,369 to Nowak et al.; U.S. Pat. No. 5,025,291 to Nowak et al.; U.S. Pat. No. 5,016,055 to Pietrowski et al.; U.S. Pat. No. 5,081,500 to Snelling; U.S. Pat. No. 5,282,005 to Nowak, et al.; U.S. Pat. No. 4,329,341 to Nowak et al.; and U.S. patent application Ser. No. 07/620,520, "Energy Transmitting Horn Bonded to an Ultrasonic Transducer for Improved Uniformity at the Horn Tip", by R. Stokes et al. adequately describe such devices, and the application of transfer improving vibration inducing devices, and are specifically incorporated herein by reference.

Figure 1:
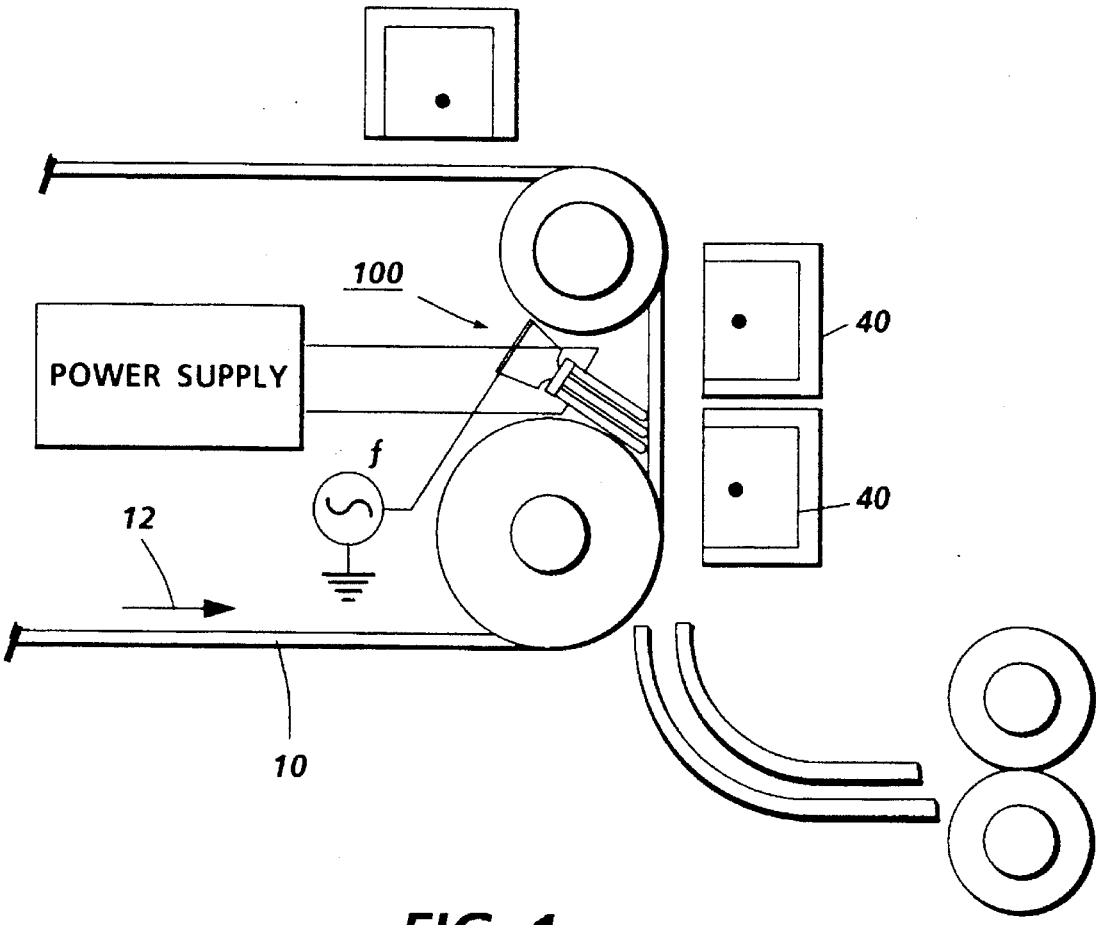
FIG. 1 is a schematic elevational view of a printing machine transfer station and the associated ultrasonic transfer enhancement device of the invention.

With reference to FIG. 1, wherein a portion of a printing machine is shown including at least portions of the transfer, detack and precleaning functions thereof, the basic principle of enhanced toner release is illustrated, where a relatively high frequency acoustic or ultrasonic resonator 100 driven by an A.C. source 102 operated at a frequency f between 20 kHz and 200 kHz, is arranged in vibrating relationship with the interior or back side of an image receiving belt 10, at a position closely adjacent to where the belt passes through a transfer station. Vibration of belt 10 agitates toner developed in imagewise configuration onto belt 10 for mechanical release thereof from belt 10, allowing the toner to be electrostatically attracted to a sheet during the transfer step, despite gaps caused by imperfect paper contact with belt 10. Additionally, increased transfer efficiency with lower transfer fields than normally used appears possible with the arrangement. Lower transfer fields are desirable because the occurrence of air breakdown (another cause of image quality defects) is reduced. Increased toner transfer efficiency is also expected in areas where contact between the sheet and belt 10 is optimal, resulting in improved toner use efficiency, and a lower load on the cleaning system. In a preferred arrangement, the resonator 100 is arranged with a vibrating surface parallel to belt 10 and transverse to the direction of belt movement 12, generally with a length approximately coextensive with the belt width. The belt described herein has the characteristic of being non-rigid, or somewhat flexible, to the extent that it can be made to follow the resonator vibrating motion. One type of photoconductive imaging member is typically multilayered and has a substrate, a conductive layer, an optional adhesive layer, an optional hole blocking layer, a charge generating layer, a charge transport layer, and, in some embodiments, an anti-curl backing layer.

Figure 2:
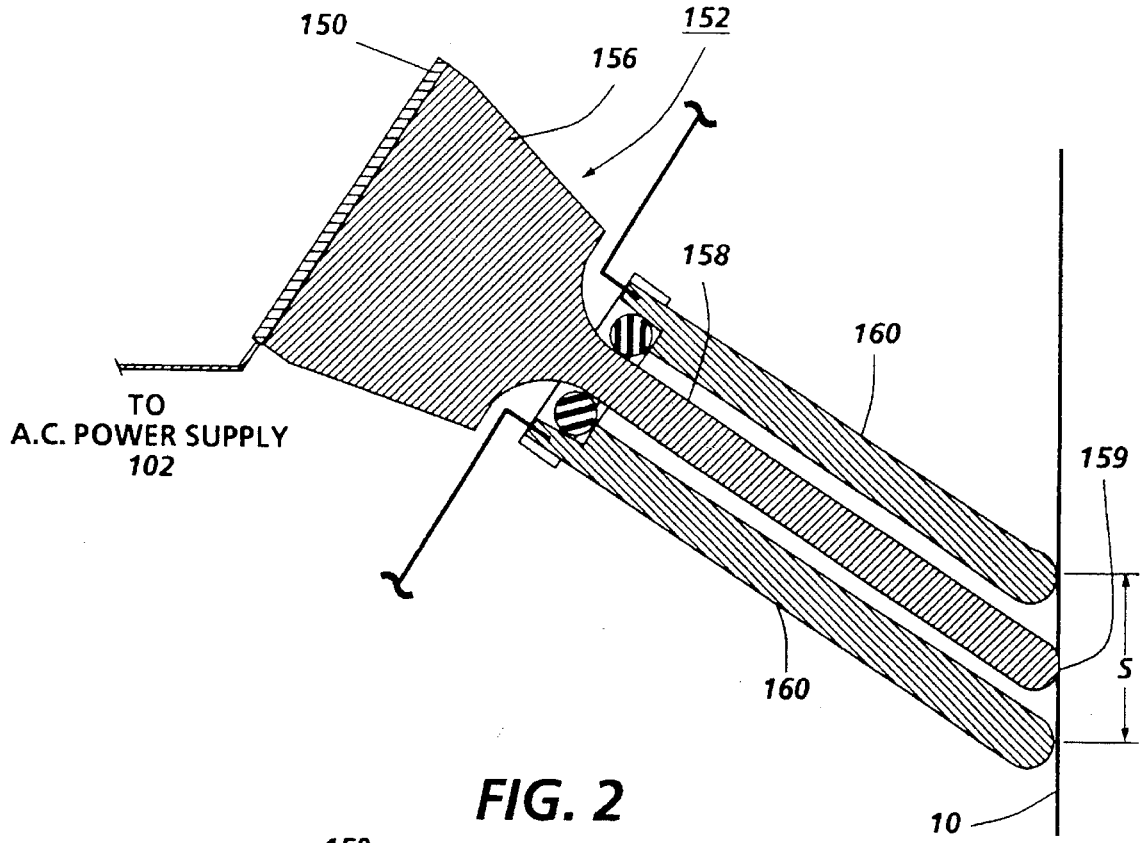
FIG. 2 is a sectional elevational view of one embodiment of the ultrasonic resonator in accordance with the invention.

With reference to FIG. 2, the vibratory energy of the resonator 100 may be coupled to belt 10 in a number of ways. In the arrangements shown, resonator 100 comprises piezoelectric transducer element 150 and horn 152. A desirable material for the horn is aluminum. The piezoelectric transducer element 150 is deposited onto horn 152 on base 156. The piezoelectric transducer element 150 comprises a piezoelectric active polymer, such as polyvinylidene fluoride (PVDF). Alternatively, other materials, might include copolymers of vinylidene fluoride and trifluoroethylene (P(VDF/TrFe)) or vinylidene fluoride and tetrafluoroethylene P(VDF/TeFe), or composite materials comprising a piezoelectric active ceramic particulate material in a polymeric binder. Piezoelectric active ceramic materials may include for example, barium titanate ($BaTiO_3$), lead zirconate titanate (PZT), or lead titanate ($PbTiO_3$). The binder polymer may include PVDF, epoxies, or any of a variety of polymer resins to provide an appropriate composite structure which may be directly deposited onto the waveguide surface. Properties of the piezoelectric polymer constituents may be selected to provide optimal displacement and coupling to the ultrasonic waveguide based upon the piezoelectric constant and elastic moduli. The preferred modulus range is between $0.2\times10^{10}$ $Nm^2$ to $1.0\times10^{10}$ $Nm^2$. Additionally, these properties may be selected to effect the vibration uniformity of the assembled transducer. To achieve the desired effect the material stiffness can be selected to alter the cross process vibrational modes. Any of a combination of these materials may be used which have been known to exhibit piezoelectric effects. Various effective suitable means can be used to apply the polymer mixture coatings to the surface of the horn such as dry powder coating and electrostatic powder cloud spraying. Alternatively, materials may be dip coated or flow coated in liquid phase. Full or partial width transducer elements may be first cast and then deposited onto the waveguide surface by heat or solvent laminating processes without introducing an adhesive layer rather than casting directly onto the waveguide surface. Preferrably the thickness of the polymer coating ranges from a few micrometers to a few millimeters selected based upon desired vibration amplitude. Depending upon the fabrication process the polymer is poled either before or after deposition onto the waveguide by applying a large electric field across the thickness of the polymer. Poling of the polymer may occur while it is heated to alleviate electrostatic field requirements. It should be evident that differential polarizing of polymer could be employed to optimize uniformity along the length of the transducer. Efficient means are disclosed in U.S. Pat. No. 5,210,577 which is hereby incorporated by reference. Piezoelectric polymer elements may be applied as a single or multiple layer to provide an even thicker active component. A conductive layer, such as aluminum, is deposited over the polymer coating surface by using such means as chemical vapor deposition or electrochemical deposition. Conductive paint materials may be applied, such as silver print, or conductive polymeric materials may be overcoated onto the piezoelectric polymer. Thicker conductive substrates may be applied with conventional bonding techniques. Density and thickness of the conductive layer may be selected to provide additional mass for the transducer design. The thickness of the conductive layer may range from a few angstroms to a few millimeters. Electrical leads, preferably conductive adhesive copper foil such as manufactured by 3M, are attached to the conductive layer and then to power supply.

Figure 3:
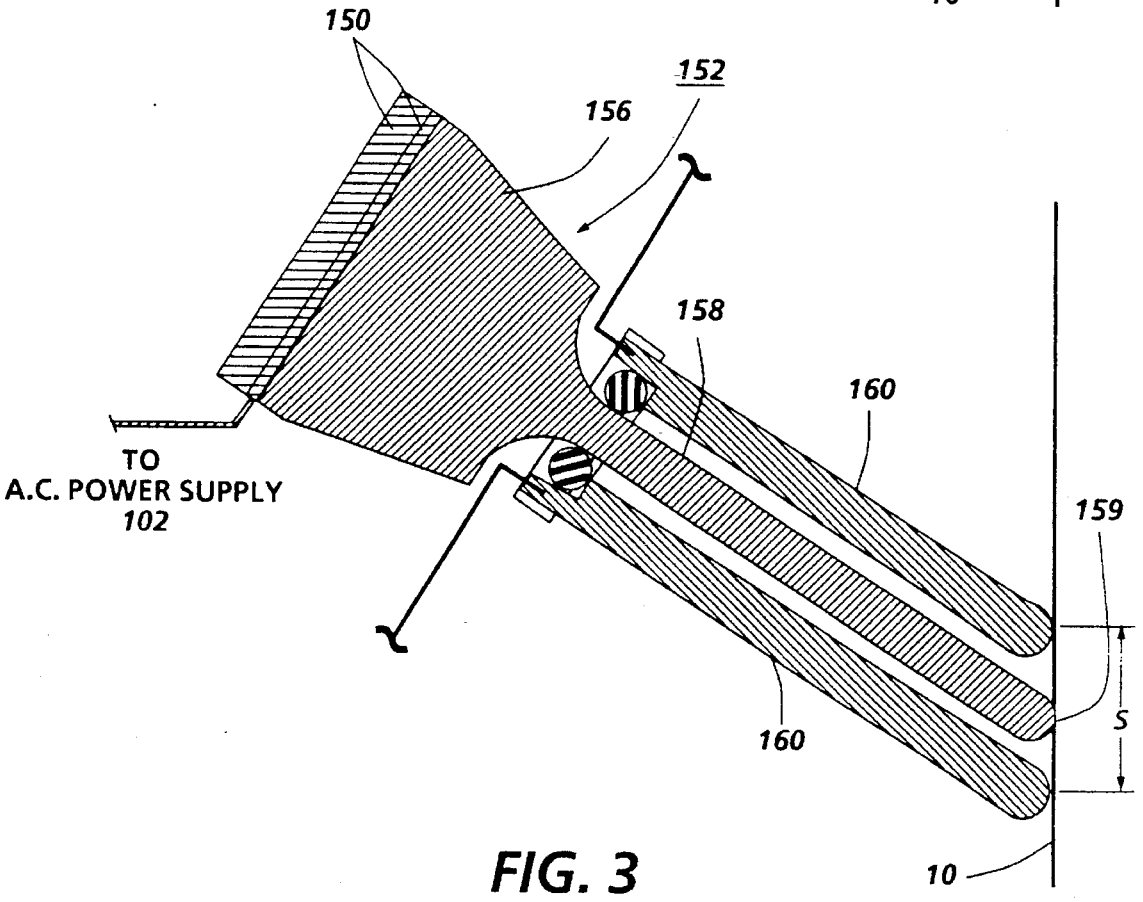
FIG. 3 is a sectional elevational view of another embodiment ultrasonic resonator in accordance with the invention.

In another embodiment, shown in FIG. 3, a piezoelectric polymer film 150 such as polyvinylidene fluoride (PVDF) is bonded with an adhesive 149 to horn 152. Obviously, a vast array of adhesives such as transfer adhesives, epoxies, cyanoacrylates, or an epoxy/conductive mesh layer may be used to bond the horn and piezoelectric polymer element together. The preferred embodiment however is to directly mount the piezoelectric transducing element onto the ultrasonic waveguide thereby eliminating the bonding layer. This alleviates any vibration attenuation which may occur due to the bond layer as well as eliminates capacitive effects of the bond layer for electrical driving purposes.

The contacting tip 159 of horn 152 may be brought into a tension or penetration contact with belt 10, so that movement of the tip carries belt 10 in vibrating motion. Penetration can be measured by the distance that the horn tip protrudes beyond the normal position of the belt, and may be in the range of 1.5 to 3.0 mm. It should be noted that increased penetration produces a ramp angle at the point of penetration. For particularly stiff sheets, such an angle may tend to cause lift at the trail edges thereof.

As shown in FIG. 2, to provide a coupling arrangement for transmitting vibratory energy from a resonator 100 to belt 10, the resonator is arranged with electrodes 160 to provide engagement of resonator 100 to belt 10 without penetrating the normal plane of the photoreceptor. Alternatively, these electrodes 160 may be replaced by plenum walls if vacuum coupling is applied.

FIG. 3 shows an assembly arranged for coupling contact with the backside of belt 10, which presents considerable spacing concerns. Accordingly, horn tip 158 extends through electrodes 160, which is connected to a high voltage source. Electrodes 160 are approximately parallel to horn tip 158, extending to approximately a common plane with the contacting tip 159, and forming together an opening adjacent to the belt 10, at which the contacting tip contacts the belt. When voltage is applied by a high voltage supply (not shown) to electrodes 160, belt 10 is drawn into contact with electrodes 160 and contacting tip 159, so that contacting tip 159 imparts the ultrasonic energy of the resonator to belt 10. Interestingly, electrodes 160 also tend to damp vibration of the belt outside the area in which vibration is desired, so that the vibration does not disturb the dynamics of the sheet tacking or detacking process, or the integrity of the developed image prior to the transfer field.

The electrostatic tacking force can be applied using either D.C. or A.C. biases to promote electrostatic fields into the bulk of the photoreceptor backside. This can occur without effecting the photoreceptor imaging function. It is preferred that the photoreceptor structure consists of the electrically insulative Anti-Curl Backing Coating in direct contact with the resonator followed by the Mylar support layer. These insulative layers occurring prior to the photoreceptor ground plane in the photoreceptor structure serve to electrically isolate the electrostatic tacking function from the photoreceptor imaging function.

With reference to FIGS. 2 and 3, application of high frequency acoustic or ultrasonic energy to belt 10 occurs within the area of application of transfer field, and preferably within the area under transfer corotron 40. While transfer efficiency improvement appears to be obtained with the application of high frequency acoustic or ultrasonic energy throughout the transfer field, in determining an optimum location for the positioning of resonator 100, it has been noted that transfer efficiency improvement is strongly a function of the velocity of the contacting tip 159. The desirable position of the resonator is approximately opposite the centerline of the transfer corotron. For this location, optimum transfer efficiency was achieved for tip velocities in the range of 300–500 mm/sec. depending on toner mass. At very low tip velocity, from 0 mm/second to 45 mm/sec, the positioning of the transducer has relatively little effect on transfer characteristics. Restriction of application of vibrational energy, so that the vibration does not occur outside the transfer field is preferred. Application of vibrational energy outside the transfer field tends to cause greater electromechanical adherence of toner to the surface creating a problem for subsequent transfer or cleaning.

Figure 4A:
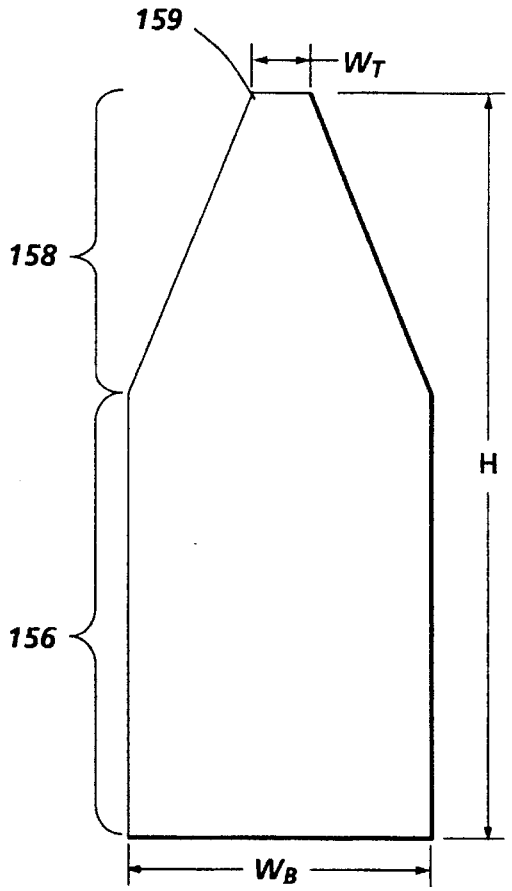
FIGS. 4A and 4B are sectional elevational views of two types of horns suitable for use with the invention.
Figure 4B:
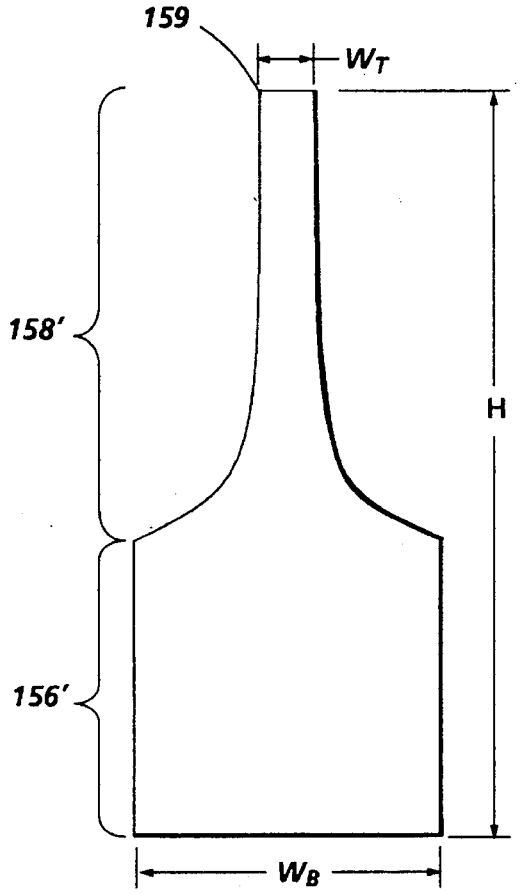

At least two shapes for the horn have been considered. With reference to FIG. 4A, in cross section, the horn may have a trapezoidal shape, with a generally rectangular base 156 and a generally triangular tip portion 158, with the base of the triangular tip portion having approximately the same size as the base. Alternatively, as shown in FIG. 4B, in cross section, the horn may have what is referred to as a stepped shape, with a generally rectangular base portion 156', and a stepped horn tip 158'. The trapezoidal horn appears to deliver a higher natural frequency of excitation, while the stepped horn produces a higher amplitude of vibration. The height H of the horn appears to have an effect on the frequency and amplitude response. Desirably the height H of the horn will fall in the range of approximately 1 to 1.5 inches (2.54 to 3.81 cm), with greater or lesser lengths not excluded. The ratio of the base width $W_B$ to tip width $W_T$ also effects the amplitude and frequency of the response with a higher ratio producing a marginally higher frequency and a greater amplitude of vibration. The ratio of $W_B$ to $W_T$ is desirably in the range of about 3:1 to about 10:1. The length L of the horn across belt 10 also effects the uniformity of vibration, with the longer horn producing a less uniform response.

Figure 5:
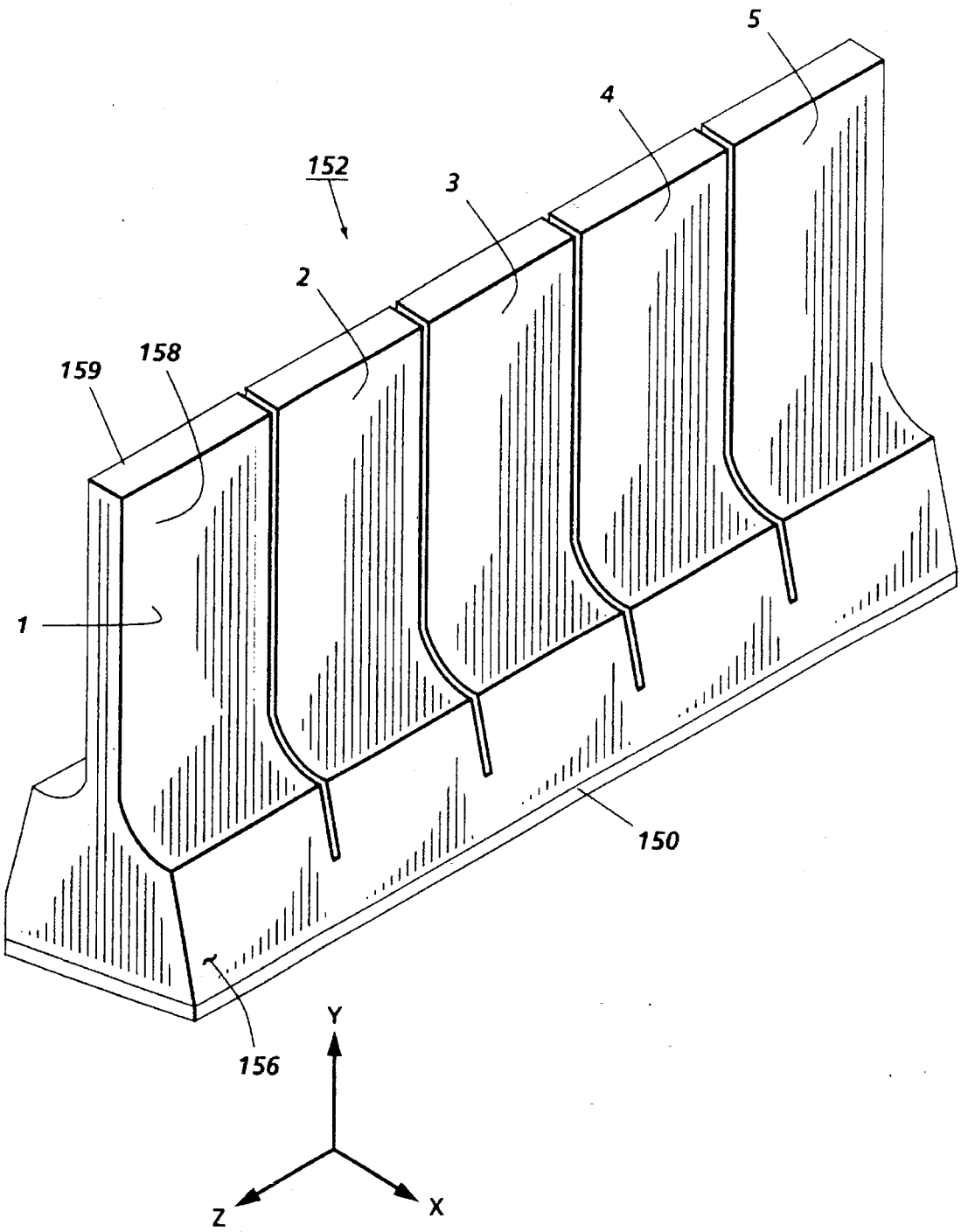
FIG. 5 is a perspective view of a resonator.
Figure 6:
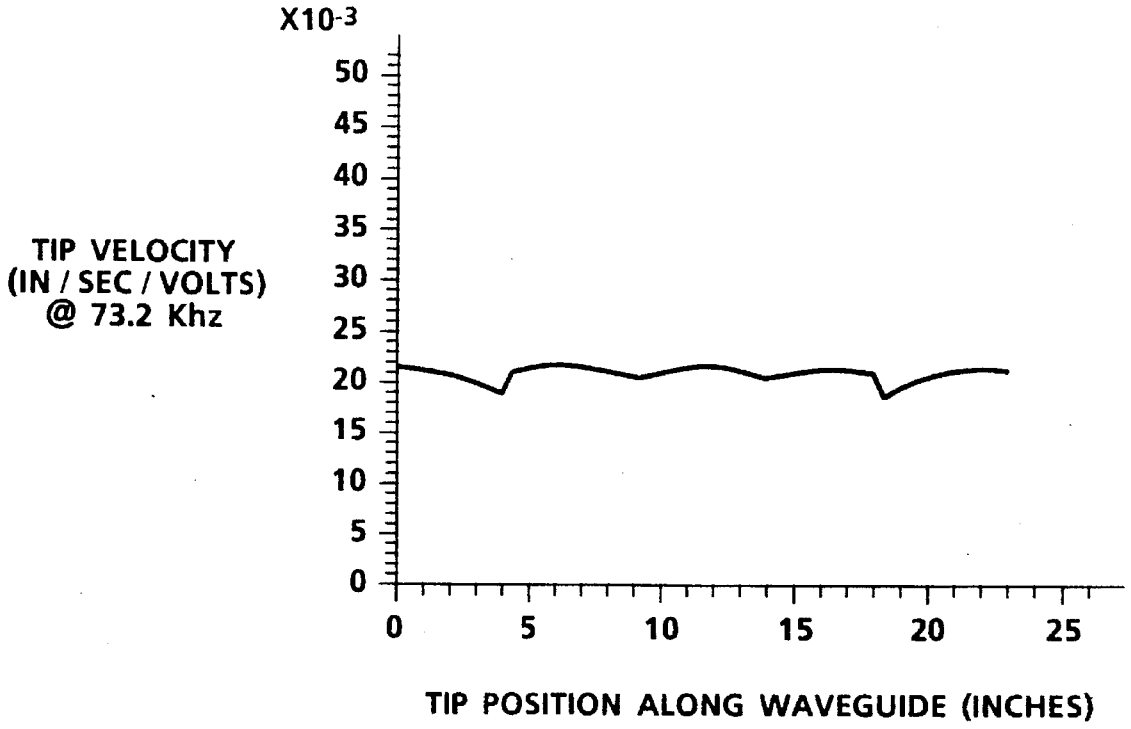
FIG. 6 is a graph of the response across the tip at a selected frequencies of the resonator of FIG. 5.

In FIG. 5, a partial horn segmentation is shown where the tip portion 158 of the horn 152 is cut perpendicularly to the plane of the imaging surface, and generally parallel to the direction of imaging surface travel, but not cut through the contacting tip 159 of the horn, while a continuous piezoelectric transducer 150 is maintained. Such an arrangement, which produces an array of horn segments 1–5, provides the response along the horn tip, as shown in FIG. 6, which illustrates the velocity response along the array of horn segments 1–5 along the horn tip which is from about 0.18 in/sec/v to 0.22 in/sec/v, when excited at a frequency of 73.2 kHz. The response tends toward uniformity across the contacting tip, but still demonstrates a variable natural frequency of vibration across the tip of the horn. It is noted that the velocity response is greater across the segmented horn tip, than across an unsegmented horn tip, a desirable result.

When horn 152 is fully segmented, each horn segment tends to act as an individual horn. When the horn is segmented though the tip, producing an open ended slot, each segment acts more or less individually in its response. It will be understood that the exact number of segments may vary from the 5 segments shown in the examples and described herein. The length $L_s$ of any segment is selected in accordance with the height H of the horn, with the ratio of H to $L_s$ falling in a range of greater that 1:1, and preferably about 3:1.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

We claim:

1. A method for fabricating a resonator for applying vibrational energy to a member comprising:

providing a horn member; and securing a piezoelectric polymer member to a surface of the horn member opposed from the member, said securing step comprises depositing the piezoelectric polymer member onto the surface of the horn member opposed from the member.

2. The method of claim 1, wherein said depositing step comprises:

coating a layer of a piezoelectric active polymer onto the surface of the horn member; and attaching a conductive layer to the piezoelectric active polymer layer.

3. The method of claim 2, further comprising applying an electrical field to the piezoelectric active polymer layer before said coating step.

4. The method of claim 2, further comprising applying an electrical field to the piezoelectric active polymer layer after said coating step.

5. A resonator, in accordance with the method of claim 1, for applying vibrational energy to a member, comprising:

a voltage source, coupled to said piezoelectric polymer member, to excite said piezoelectric polymer member to generate the high frequency vibratory energy required to drive said horn member.

6. The resonator as described in claim 1, wherein said piezoelectric polymer member comprises:

a layer of a piezoelectric active polymer; and a conductive layer adjacent to said piezoelectric active polymer.

7. The resonator as described in claim 6, wherein said piezoelectric active polymer is selected from the group consisting of piezoelectric ceramic material and binder resin composite, piezoelectric active resins, and mixtures thereof.

8. The resonator as described in claim 7, wherein said piezoelectric active resins comprise monomers selected from the group consisting of vinylidene fluoride, trifluoroethylene, tetrafluoroethylene, and copolymers thereof.

9. The resonator as described in claim 7, wherein said piezoelectric ceramic material is selected from the group consisting of barium titanate, lead zirconate titanate, and lead titanate.

* * * * *